US011162665B2

(12) United States Patent
Worman

(10) Patent No.: US 11,162,665 B2
(45) Date of Patent: Nov. 2, 2021

(54) PORTABLE LIGHT HAVING AN INTERCHANGEABLE TAIL CAP

(71) Applicant: STREAMLIGHT, INC., Eagleville, PA (US)

(72) Inventor: William D. Worman, Phoenixville, PA (US)

(73) Assignee: Streamlight, Inc., Eagleville, PA (US)

( * ) Notice: Subject to any disclaimer, the term of this patent is extended or adjusted under 35 U.S.C. 154(b) by 1 day.

(21) Appl. No.: 16/876,894

(22) Filed: May 18, 2020

(65) Prior Publication Data

US 2021/0025568 A1 Jan. 28, 2021

Related U.S. Application Data

(63) Continuation of application No. 29/711,469, filed on Oct. 31, 2019, and a continuation of application No. 29/699,109, filed on Jul. 23, 2019, now Pat. No. Des. 907,268, application No. 16/876,894, which is a continuation of application No. 29/699,118, filed on Jul. 23, 2019, now Pat. No. Des. 907,270, application No. 16/876,894, which is a continuation of application No. 29/699,113, filed on Jul. 23, 2019, now Pat. No. Des. 907,269, application No. 16/876,894, which is a continuation of application No. 29/699,103, filed on Jul. 23, 2019, now Pat. No. Des. 907,267.

(51) Int. Cl.

| | |
|---|---|
| ***F21V 17/00*** | (2006.01) |
| ***F21V 23/04*** | (2006.01) |
| ***F41G 1/35*** | (2006.01) |
| ***F21L 4/00*** | (2006.01) |
| ***F21V 21/088*** | (2006.01) |

(52) U.S. Cl.

CPC ..... *F21V 17/002* (2013.01); *F21L 4/00* (2013.01); *F21V 21/0885* (2013.01); *F21V 23/0421* (2013.01); *F41G 1/35* (2013.01)

(58) Field of Classification Search

CPC ..... F21V 17/002; F21V 21/0885; F21V 23/0421; F21V 15/01; F21V 19/004; F41G 1/35; F21L 4/00

USPC ..... 362/374; 42/132, 146

See application file for complete search history.

(56) References Cited

U.S. PATENT DOCUMENTS 9,488,439 B2 11/2016 Galli et al.
9,810,411 B2 11/2017 Galli et al.
(Continued)

OTHER PUBLICATIONS

Bayco Products, Inc. "Nighstick TCM-550XL Compact Tactical Weapon-Mounted Light", © 2020, 3 pages, https://www.baycoproducts.com/product/weapon-mounted-lights/item/tcm-550xl.

(Continued)

*Primary Examiner* — John Cooper

(74) *Attorney, Agent, or Firm* — Clement A. Berard, Esq.; Dann, Dorfman, Herrell & Skillman, PC

(57) ABSTRACT

A portable light comprises a light body having a light source and a tail cap assembly. The tail cap assembly includes a tail cap housing and at least one actuator that is pivotably mounted to the tail cap housing spaced away from a centerline of the light, and that extends across the centerline. The actuator has an actuation feature on the opposite side of the centerline that extends for actuating an electrical switch in the light body, whereby the portable light may be actuated over a wide range of angles.

35 Claims, 8 Drawing Sheets

(56) References Cited

U.S. PATENT DOCUMENTS

| | | | | |
|---|---|---|---|---|
| 9,958,143 | B2 | 5/2018 | Galli et al. | |
| 10,344,959 | B2 | 7/2019 | Worman et al. | |
| 10,612,761 | B1 | 4/2020 | Worman et al. | |
| 10,697,623 | B2 | 6/2020 | Worman et al. | |
| 10,928,051 | B1 * | 2/2021 | Worman | F41G 11/004 |
| 2017/0268849 | A1 * | 9/2017 | Conner | F21V 23/04 |
| 2018/0094900 | A1 * | 4/2018 | Sharrah | F41A 19/11 |
| 2018/0283670 | A1 | 10/2018 | Galli et al. | |
| 2019/0154243 | A1 * | 5/2019 | Worman | F21V 23/0421 |

OTHER PUBLICATIONS

Bayco Products, Inc. "Nighstick TCM-550XL Instruction Manual", undated, 3 pages, www.nightstick.com.

Nitecore, "P05 Pink", © 2012-2017, 20 pages, https://flashlight.nitecore.com/product/p05pink.

Nitecore, "P05 User Manual", undated, 1 page, https://flashlight.nitecore.com/product/p05pink.

Streamlight, Inc., "Mountable Light", Design U.S. Appl. No. 29/699,103, filed Jul. 23, 2019, 22 pages.

Streamlight, Inc., "Mountable Light", Design U.S. Appl. No. 29/699,109, filed Jul. 23, 2019, 22 pages.

Streamlight, Inc., "Mountable Light", Design U.S. Appl. No. 29/699,113, filed Jul. 23, 2019, 22 pages.

Streamlight, Inc., "Mountable Light", Design U.S. Appl. No. 29/699,118, filed Jul. 23, 2019, 22 pages.

Streamlight, Inc., "Mountable Light", Design U.S. Appl. No. 29/711,469, filed Oct. 31, 2019, 32 pages.

Streamlight, Inc., European Union Intellectual Property Office, Registered Community Design No. 007020706-0001, Registered Oct. 14, 2019, 7 pages.

Streamlight, Inc., European Union Intellectual Property Office, Registered Community Design No. 007020706-0002, Registered Oct. 14, 2019, 7 pages.

Streamlight, Inc., European Union Intellectual Property Office, Registered Community Design No. 007020706-0003, Registered Oct. 14, 2019, 7 pages.

Streamlight, Inc., European Union Intellectual Property Office, Registered Community Design No. 007020706-0004, Registered Oct. 14, 2019, 7 pages.

Streamlight, Inc., European Union Intellectual Property Office, Registered Community Design No. 007833462-0001, Registered Apr. 23, 2020, 4 pages.

Streamlight, Inc., European Union Intellectual Property Office, Registered Community Design No. 007833462-0002, Registered Apr. 23, 2020, 4 pages.

* cited by examiner

PORTABLE LIGHT HAVING AN INTERCHANGEABLE TAIL CAP

This Application is a continuation of U.S. patent application Ser. No. 29/699,103 filed Jul. 23, 2019 entitled "MOUNTABLE LIGHT," and is a continuation of U.S. patent application Ser. No. 29/699,109 filed Jul. 23, 2019 entitled "MOUNTABLE LIGHT," and is a continuation of U.S. patent application Ser. No. 29/699,113 filed Jul. 23, 2019 entitled "MOUNTABLE LIGHT," and is a continuation of U.S. patent application Ser. No. 29/699,118 filed Jul. 23, 2019 entitled "MOUNTABLE LIGHT," and is a continuation of U.S. patent application Ser. No. 29/711,469 filed Oct. 31, 2019 entitled "MOUNTABLE LIGHT," each of which is hereby incorporated herein by reference in its entirety.

The present invention relates to a portable light and, in particular, to a portable light having an interchangeable tail cap and, optionally, is mountable to an object.

Everyone has their own favorite. And that is true of users of portable lights just as it is for users of other articles. Some users of portable lights prefer a push button actuator, some prefer a slide actuator and others prefer a contoured actuator. Where a portable light is mountable to an object users often prefer an actuator that they find comfortable when gripping the object in a common way.

Where the object to which a light is mountable is, e.g., a firearm, most users prefer a light that is actuatable by a forefinger or second finger of the hand that grips the firearm in the vicinity of its trigger, e.g., from a firing grip, or by the thumb of the other hand used to steady the firearm. However, within that group are those who prefer an actuator that responds to being pressed or moved upward or downward while others prefer an actuator that responds to being pressed inwardly from the side, e.g., based upon their particular anatomy and simply upon subjective preference, and others may prefer an actuator that could be pushed forwardly.

Further, within each group of users are those who prefer the actuator to be higher, e.g., closer to the barrel of the firearm, and those who prefer it be lower, e.g., further away from the barrel. In addition, the particular shape of the actuator is also subject to personal likes and dislikes. Other users might prefer differently shaped actuators when using a light on different objects, e.g., different firearms.

The result of such individuality and preferences has been a proliferation of different portable lights that have different actuator configurations each designed to fit the preferences of what the manufacturer deems to be, e.g., the predominant preference at any given time.

In one example, a pair of pivoted actuators is provided at the rear of the light to actuate an internal switch when pressed downward, e.g., away from the mount by which the light is mounted on a firearm. The actuator pivots are centered vertically with one located towards the left side and the other located towards the right side. Actuation requires a downward force applied at a ledge of the actuator. The actuator is in a fixed central location vertically which may not be preferred by many users, and does not operate when pressed forwardly, i.e. toward the body of the light.

This and other fixed actuator variations has resulted in a great variety of different portable lights having different configurations and different actuators. Users thereof who otherwise might share a portable light with others may have to choose either to procure a light of their own that comes closer to their preferences or to put up with a shared light that is not to their liking.

Applicant believes there may be a need for a portable light configured such that the actuator or actuators thereof can easily and conveniently be changed to suit one or more users and/or different firearms. There may also be a need for an actuator arrangement that is operative not only in a vertical direction, but also when pressed forwardly toward the body of the light.

Accordingly, a portable light may comprise: a light body including a body housing, a light head including a light source for providing light, and a tail cap assembly at a rearward end of the body housing, an electrical switch therein for selectively energizing the light source for producing light, and wherein the light body defines a centerline; the tail cap assembly including a tail cap housing and at least one actuator thereon, wherein one end of the actuator is pivotably mounted thereon at a location spaced away from the centerline in a first direction, wherein the actuator extends beyond the center line in a direction opposite to the first direction and has an actuation feature thereat that is spaced apart from the pivotable mounting and that extends towards the exterior surface of the tail cap housing for actuating the electrical switch therein when the actuator is pivoted towards the exterior surface of the tail cap assembly. The centerline is between the pivotable mounting of the actuator and the actuation feature thereof.

A portable light may comprise: a light body including a body housing, a light head including a light source for providing light, and an interchangeable tail cap assembly at a rearward end of the body housing, an electrical switch therein for selectively energizing the light source for producing light, wherein the light body defines a centerline, and wherein the interchangeable tail cap assembly is one of a set of interchangeable tail cap assemblies; each interchangeable tail cap assembly of the set thereof including a tail cap housing and at least one actuator thereon, wherein one end of the actuator is pivotably mounted to an exterior surface of the tail cap housing at a location spaced away from the centerline in a first direction, wherein the actuator extends beyond the center line in a direction opposite to the first direction and has an actuation feature thereat that is spaced apart from the pivotable mounting and that extends towards the exterior surface of the tail cap housing for actuating the electrical switch in the light body when the actuator is pivoted towards the exterior surface of the tail cap assembly, wherein the centerline is between the pivotable mounting of the actuator and the actuation feature thereof; and wherein at least one interchangeable tail cap assembly of the set thereof has an actuation surface of the actuator thereof located at a location along a longer side thereof away from the centerline in the first direction and at least one other interchangeable tail cap assembly of the set thereof has the actuation surface of the actuator thereof located at a location along the longer side of the actuator away from the centerline in a direction opposite to the first direction.

Further, a portable light may comprise: a light body including a body housing having a clamping arrangement on one side thereof for attaching the portable light to a firearm, a light head at a forward end of the body housing including a light source for providing light, and an interchangeable tail cap assembly at a rearward end of the body housing, wherein the light body includes an electrical switch therein for selectively energizing the light source of the light head for producing light, wherein the light body defines a centerline, and wherein the interchangeable tail cap assembly is one of a set of interchangeable tail cap assemblies; each interchangeable tail cap assembly of the set thereof including a tail cap housing and at least one actuator thereon, wherein one end of the actuator is pivotably mounted to an exterior surface of the tail cap housing at a location spaced away from the centerline in a first direction towards the one side of the body housing, wherein the actuator extends beyond the center line in a direction opposite to the first direction and has an actuation feature thereat that is spaced apart from the pivotable mounting and that extends towards the exterior surface of the tail cap housing for actuating the electrical switch in the light body when the actuator is pivoted towards the exterior surface of the tail cap assembly, wherein the centerline is between the pivotable mounting of the actuator and the actuation feature thereof; and wherein at least one interchangeable tail cap assembly of the set thereof has an actuation surface of the actuator thereof located at a location along a longer side thereof away from the centerline in the first direction and at least one other interchangeable tail cap assembly of the set thereof has the actuation surface of the actuator thereof located at a location along the longer side of the actuator away from the centerline in a direction opposite to the first direction.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1A:
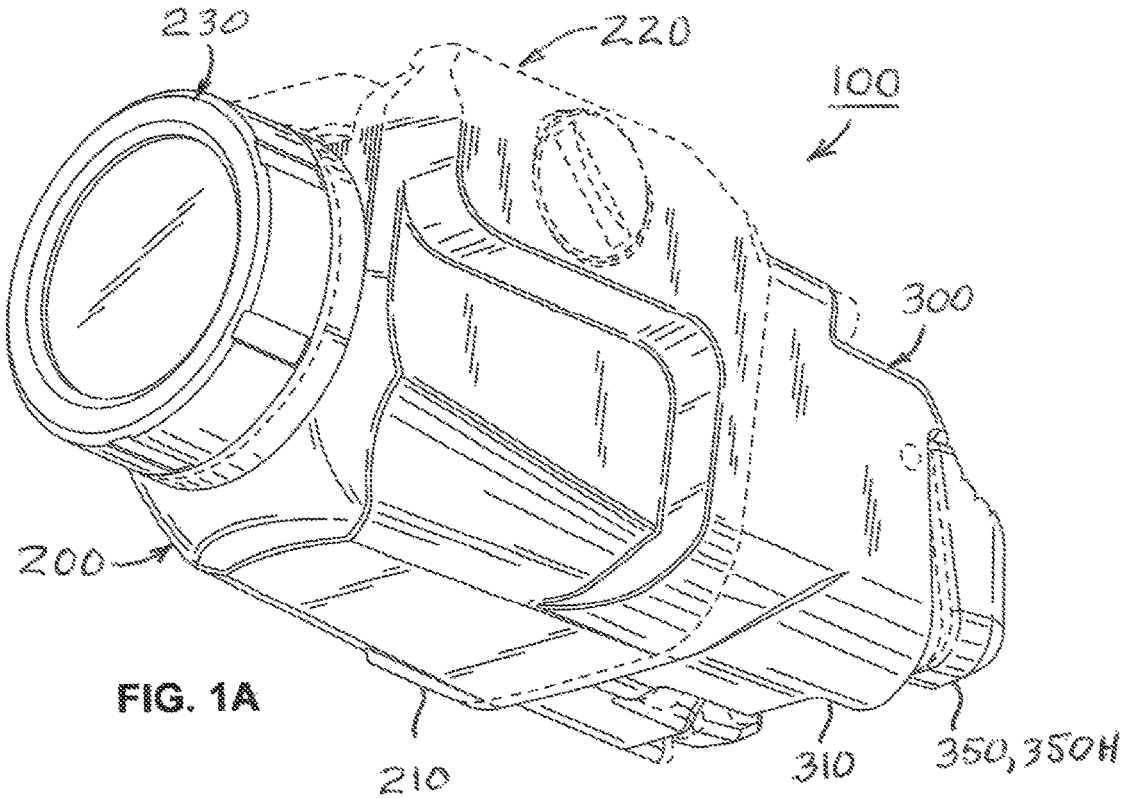
FIGS. 1A and 1B are perspective views of a first example embodiment of a portable light having one or more actuators of a first type thereon.

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

Figure 1B:
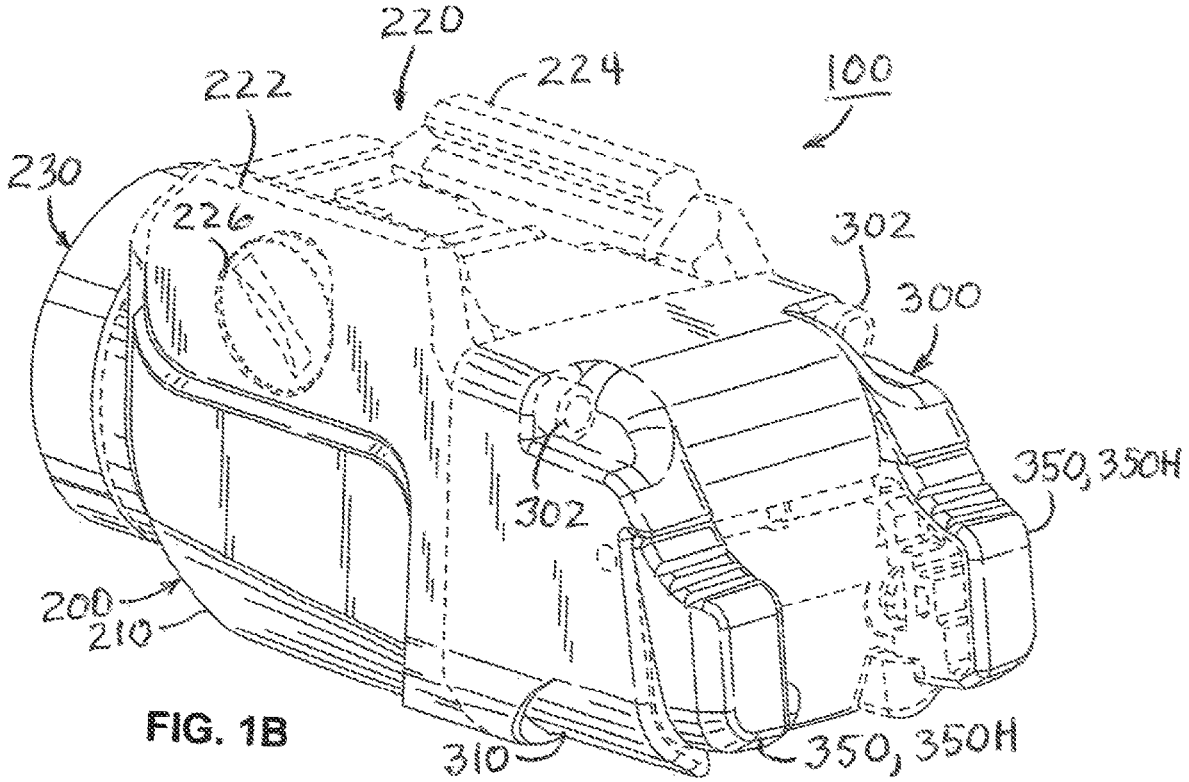
Figure 2A:
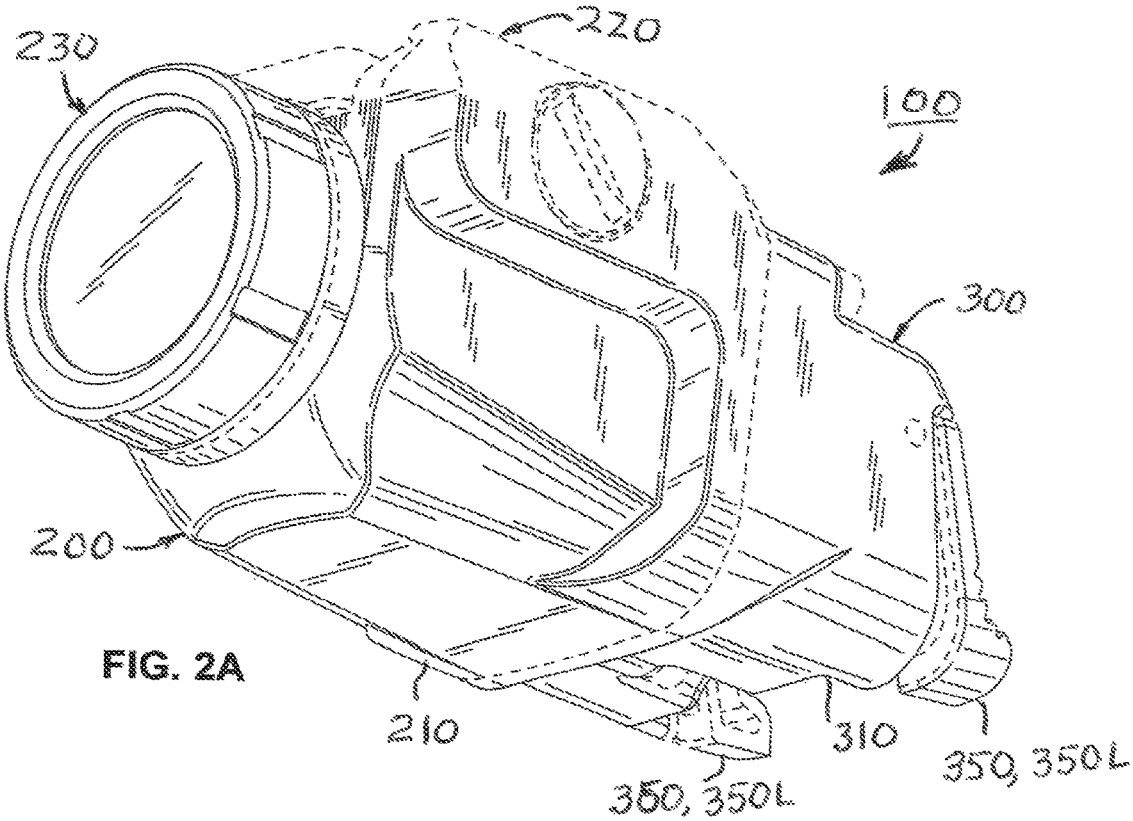
FIGS. 2A and 2B are perspective views of the first example embodiment of a portable light having one or more actuators of a second type thereon.
Figure 2B:
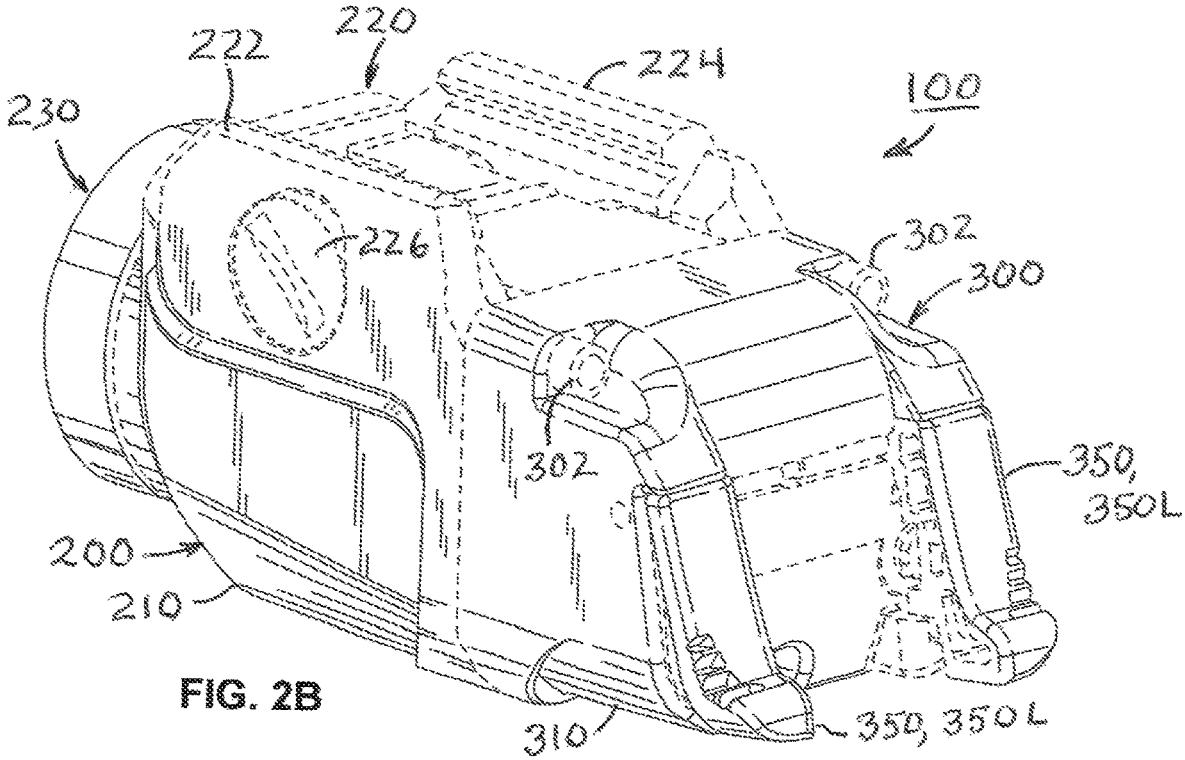

FIGS. 1A and 1B are perspective views of a first example embodiment of a portable light 100 having one or more actuators 350 of a first type 350H thereon; and FIGS. 2A and 2B are perspective views of the first example embodiment of a portable light 100 having one or more actuators 350 of a second type 350L thereon. Portable light 100 includes a light body 200 including a body housing 210, a clamping arrangement 220 for attaching (mounting) the light 100 to an object, e.g., a firearm, a light head 230 for producing light and projecting the light in a generally forward direction, and a tail cap assembly 300.

In a typical usage, light 100, 100' is mounted to a firearm beneath the barrel thereof and forwardly adjacent to the trigger guard thereof, and so the terms "top" and "upper side" are generally used to refer to the side of light 100, 100' having mounting 220, the "front" is generally the end of light 100, 100' having light head 230 and the rear is the end of light 100, 100' having actuators 350. However, other uses and mountings are contemplated.

Body housing 210 supports clamping arrangement 220 which in one example embodiment includes a fixed clamp member 222, a movable clamp member 224 and a clamp mechanism 226, e.g., clamp screw 226, that tightens clamp members 222, 224 to fasten light 100 to an object, e.g., a firearm, and loosens clamp members 222, 224 to release light 100 from the object. Any suitable clamping or other attaching arrangement 220 may be employed.

Light head 230 is mounted at the forward end of the light 100 and includes a light source so as to direct light forwardly when energized. Body housing 210 typically includes a cavity for receiving a source of electrical power, e.g., one or more batteries, for providing electrical power to a light source of light head 230 and control circuitry for selectively energizing the light source. Typically, light head 230 screws into a threaded opening at the forward end of body housing 210 through which the source of electrical power may be installed into and removed from the cavity internal to body housing 210.

Tail cap assembly 300, which is often referred to simply as tail cap 300, includes a tail cap housing 310 that is attached to the rearward end of body housing 210, e.g., by one or more fasteners 302. Tail cap housing 310 includes one or more actuators 350 on the rearward part thereof that may be moved by a user for energizing and de-energizing the light source of light head 230, e.g., by actuating one or more electrical switches disposed within light body 200, e.g., proximate the rear portion of tail cap 300.

In a typical light 100, pressing either actuator 350 for a short time, e.g., less than about 0.25 second, causes the light source of light head 230 to turn ON if OFF and pressing either actuator 350 for a second short time causes light head to turn OFF, in a toggling back and forth manner alternating between ON and OFF. Pressing either actuator 350 for a relatively longer time, e.g., more than about 0.25 second, when light 100 is OFF causes the light source of light head 230 to turn ON for as long as actuator 350 is held in the pressed position.

As will be more evident from further description below, tail cap 300 has a pivot located near the upper part of the rearward side thereof on which an end of actuator 350 pivots. Actuator 350 has an actuating feature located near the vertical center of the rearward side of tail cap 300 that is movable inwardly and outwardly towards or through an opening in tail cap 300 so as to directly or indirectly actuate an electrical switch disposed within light body 200.

Actuator 350 is shaped to include a surface extending in a rearward direction to provide a ledge or actuator surface against which a user presses a finger to actuate the electrical switch interior the light 100. Because of the respective locations of the pivot and the actuating feature relative to tail cap 300, e.g., the pivot being above the centerline of light 100 and the actuating feature below the centerline, actuator 350 will actuate the internal electrical switch when pressed in a wide variety of directions, including at least a downward direction and a forward direction and any direction therebetween.

In the light 100 embodiment, one tail cap 300 includes actuators 350, 350H of a first type that have actuator surfaces that are in a high, or HI, position, e.g., above the actuating feature, while another tail cap 300 includes actuators 350, 350L of a second type that have actuator surfaces that are in a low, or LO, position, e.g., below the actuating feature. Actuators 350 may be shaped to have an actuator surface that is above, or below or at the same vertical location as the opening through the rear of tail cap 300, as may be desirable or convenient to the preferences of the manufacturer or of a user.

Tail caps 300 are interchangeable irrespective of which actuator 350, 350H, 350L, or an actuator 350 having another shape, is provided thereon. To this end, the periphery of the forward end of the tail cap housings 310 and the locations and positions of the openings therein are all the same, so that which ever one of tail cap housings 310 is used will fit properly adjacent to the rearward end of body housing 210 with the openings proximate the internal electrical switches. The internal structure of body housing 210 and parts thereof internal to light 10 are the same and are fixed in predetermined positions for providing interchangeability of tail caps 300.

Advantageously, the configuration of actuator 350, and various high and low actuator variations 350H, 350L not only allows the actuator to be arranged in many different configurations that may be desirable to many different user preferences, it also further accommodates user preferences and differences by being actuatable by being pressed over a wide range of directions from at least downward vertically to forward horizontally. As a result, the present arrangement is though to accommodate a wider range of users including those who prefer to use a finger of their firing hand to actuate their gun-mounted light and those who prefer to use the thumb of their support hand to actuate the light.

Figure 3A:
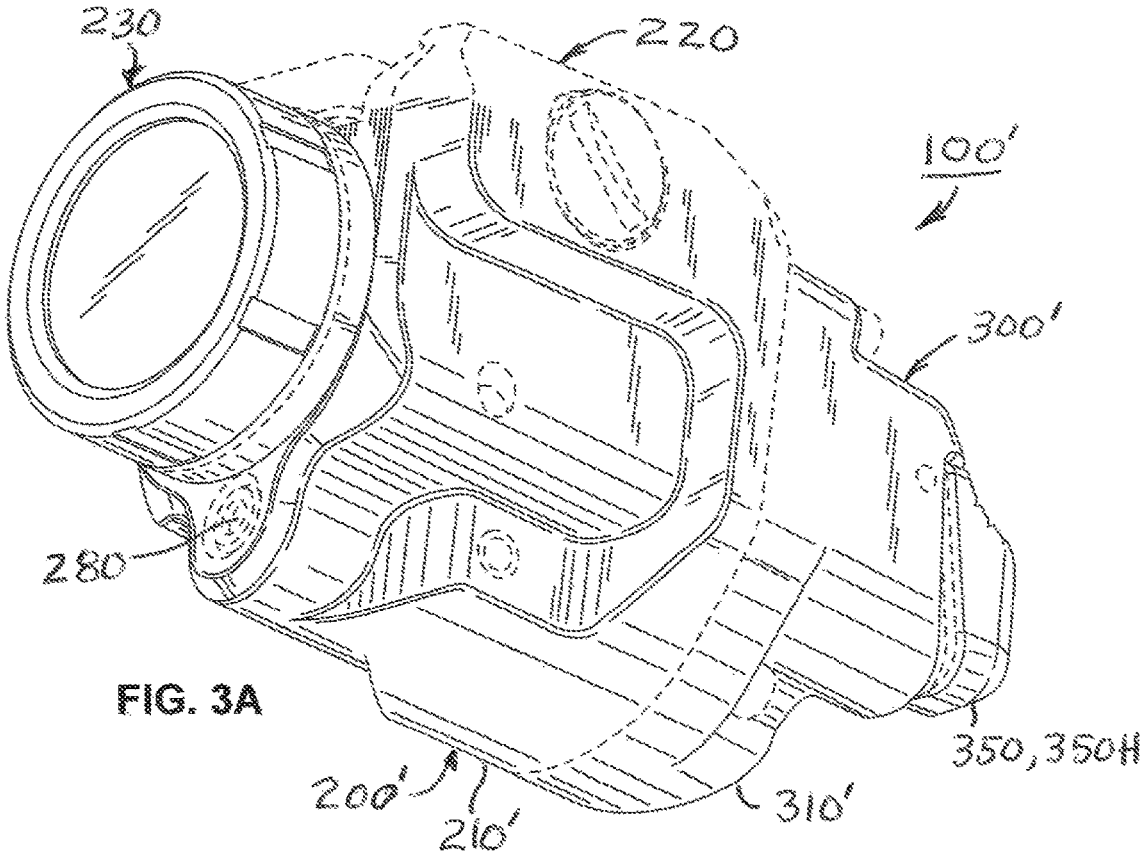
FIGS. 3A and 3B are perspective views of a second example embodiment of a portable light having one or more actuators of the first type thereon.
Figure 3B:
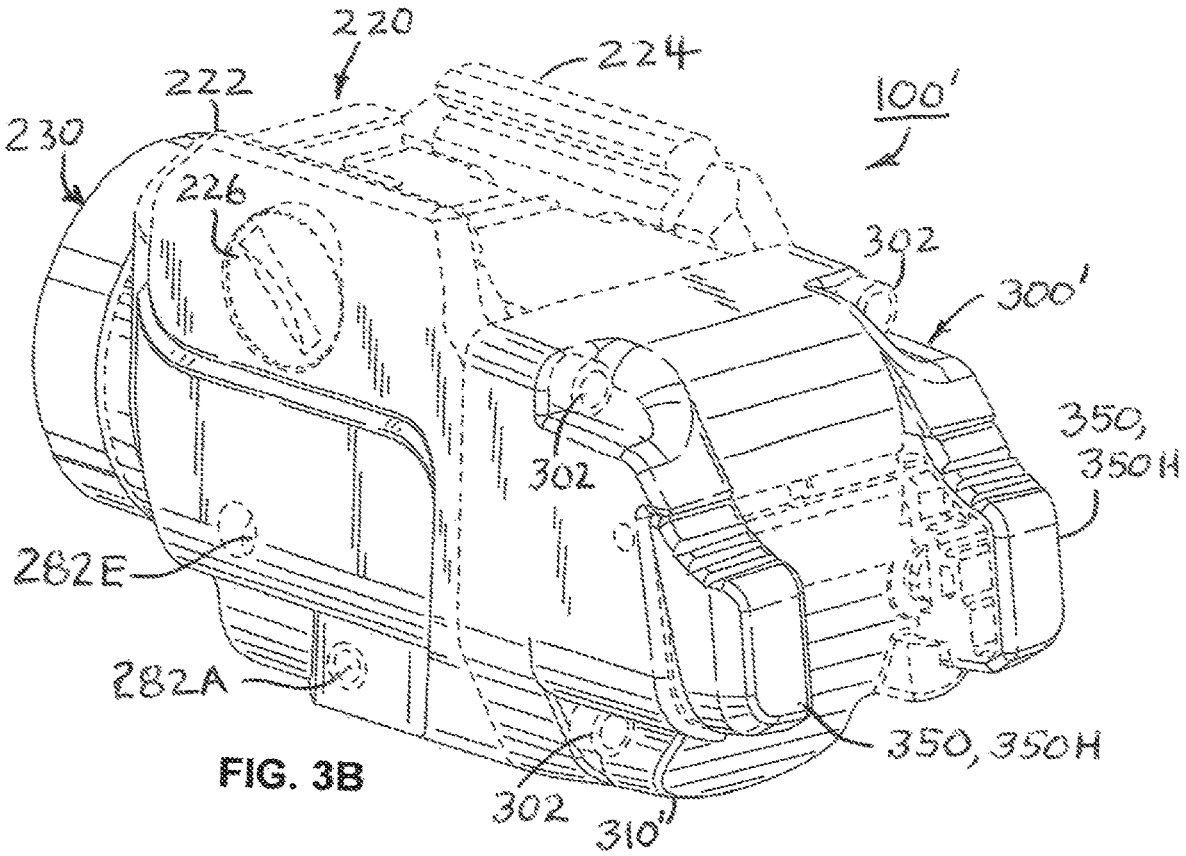
Figure 4A:
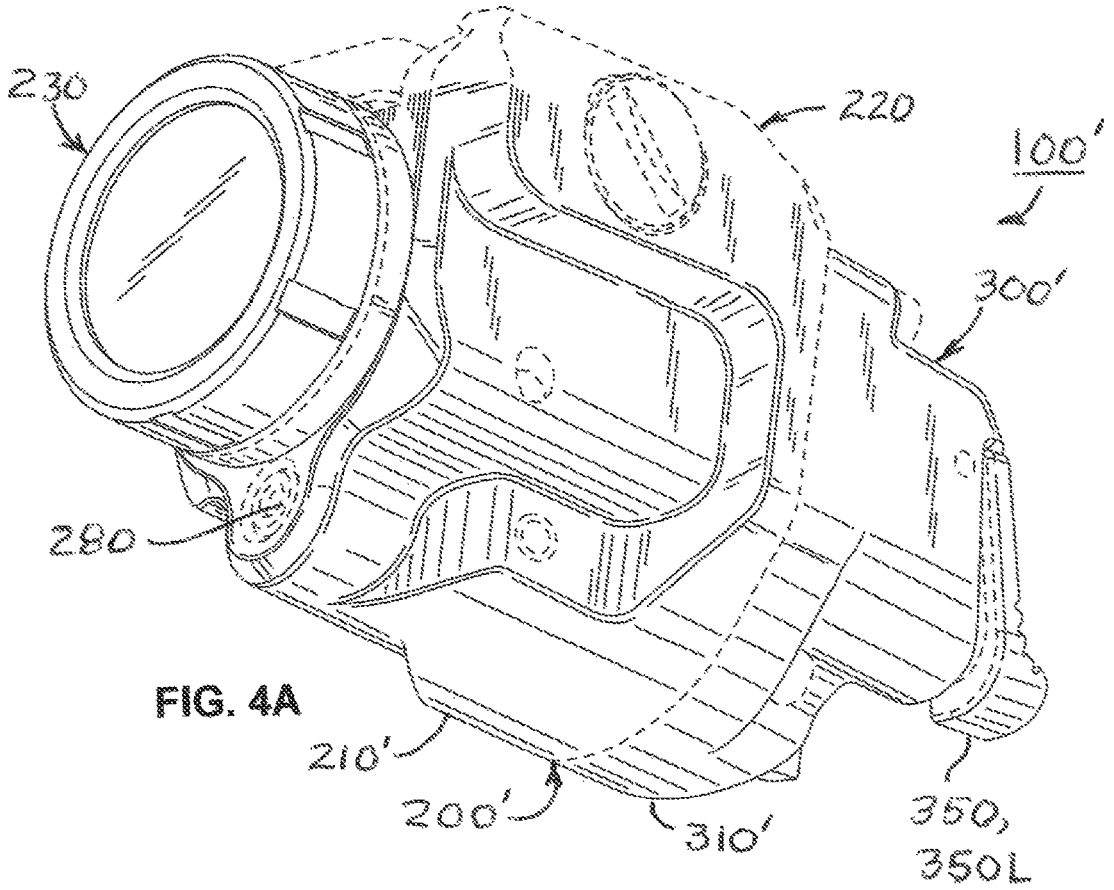
FIGS. 4A and 4B are perspective views of the second example embodiment of a portable light having one or more actuators of the second type thereon.
Figure 4B:
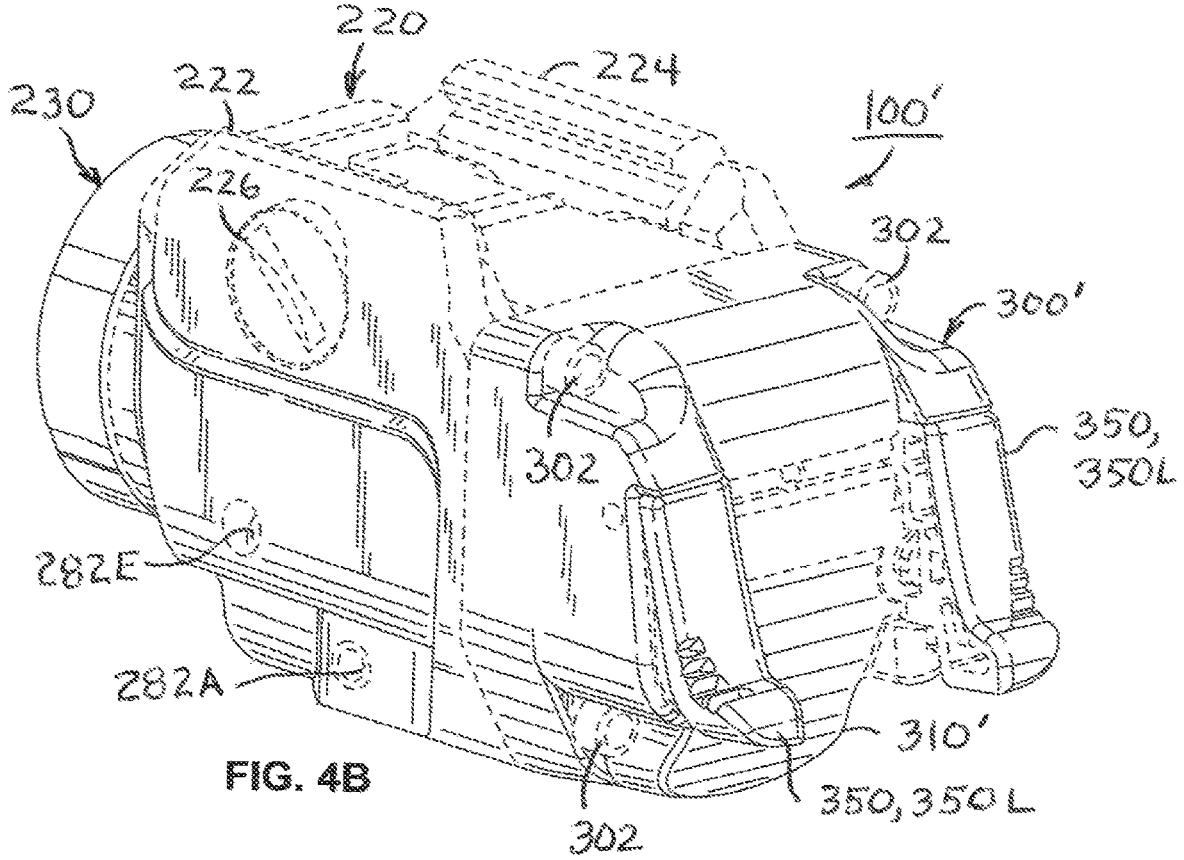

FIGS. 3A and 3B are perspective views of a second example embodiment of a portable light 100' having one or more actuators 350 of the first type 350H thereon; and FIGS. 4A and 4B are perspective views of the second example embodiment of a portable light 100' having one or more actuators 350 of the second type 350L thereon. Portable light 100' includes a light body 200' including a body housing 210', a clamping arrangement 220 for attaching the light 100' to an object, e.g., a firearm, a light head 230 for producing light and projecting the light in a forward direction, and a tail cap assembly 300' or tail cap 300'.

Light 100' differs from light 100 in that light body 200' includes a secondary light source 280 that directs secondary light in a generally forward direction, e.g., in substantially the same direction as illumination light from light head 230. Secondary light source 280 may be disposed in light body 200, e.g., above or below or to the right or the left of light head 230, or may be disposed therein.

Secondary light source 280 may be, e.g., an infrared (IR) light source providing IR illumination as is useful with night vision equipment, or may be, e.g., a laser light source providing a laser light beam useful for aiming the firearm onto which light 100' is mounted to be directed to an intended target. The aiming laser light may be visible, e.g., red or green laser light, or not visible, IR laser light.

Light body housing 210' and tail cap housing 310' differ from light body housing 210 and tail cap housing 310 in that their shapes are different as necessary to accommodate light source 280 disposed in body housing 210. Body housing 210' typically has openings 282A and 282E for accessing threaded members that are rotated to adjust the azimuth and elevation, respectively, of light source 280. Accordingly, the descriptions herein relative to light 100 and the various parts, aspects and operation thereof also describe light 100' and the various parts, aspects and operation thereof.

Actuators 350, 350H, 350L are employed in light 100 for controlling the light source of light head 230. Actuators 350, 350H, 350L are employed in light 100' for controlling both the light source of light head 230 and light source 280. Operating modes that may be selectable may include, e.g., illumination light only, secondary light only, and both illumination and secondary light together.

One suitable arrangement of example light body housings 210, 210' and of an example light head 230 for example lights 100, 100' may be found in U.S. Pat. No. 10,344,959 entitled "PORTABLE AND/OR MOUNTABLE LIGHT" which is assigned to Streamlight, Inc. and which is hereby incorporated herein by reference in its entirety.

Figure 5A:
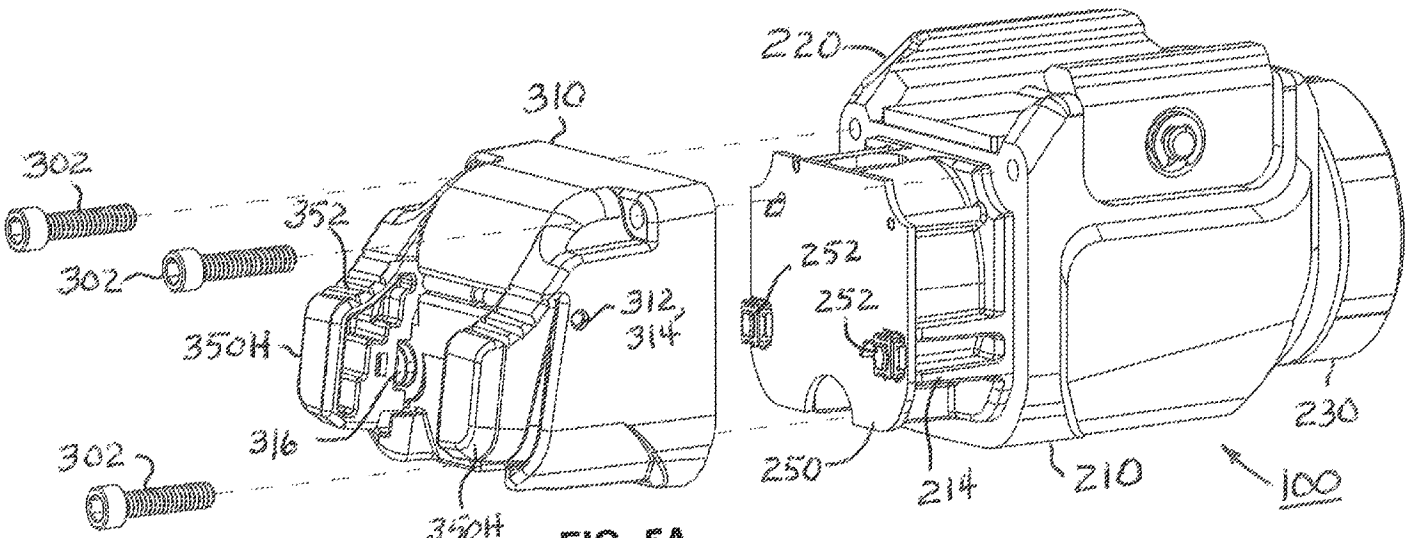
FIG. 5A is an exploded view of the first example light having the actuator of the first type.
Figure 6A:
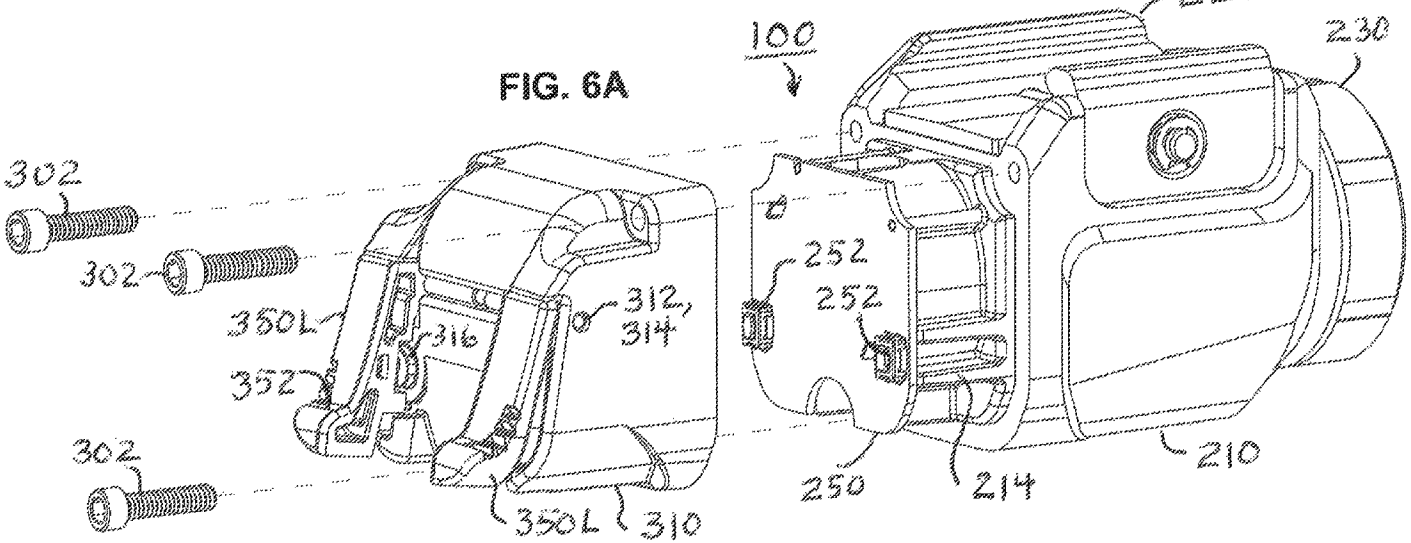
FIG. 6A is an exploded view of the second example light having the actuator of the second type.
Figure 5B:
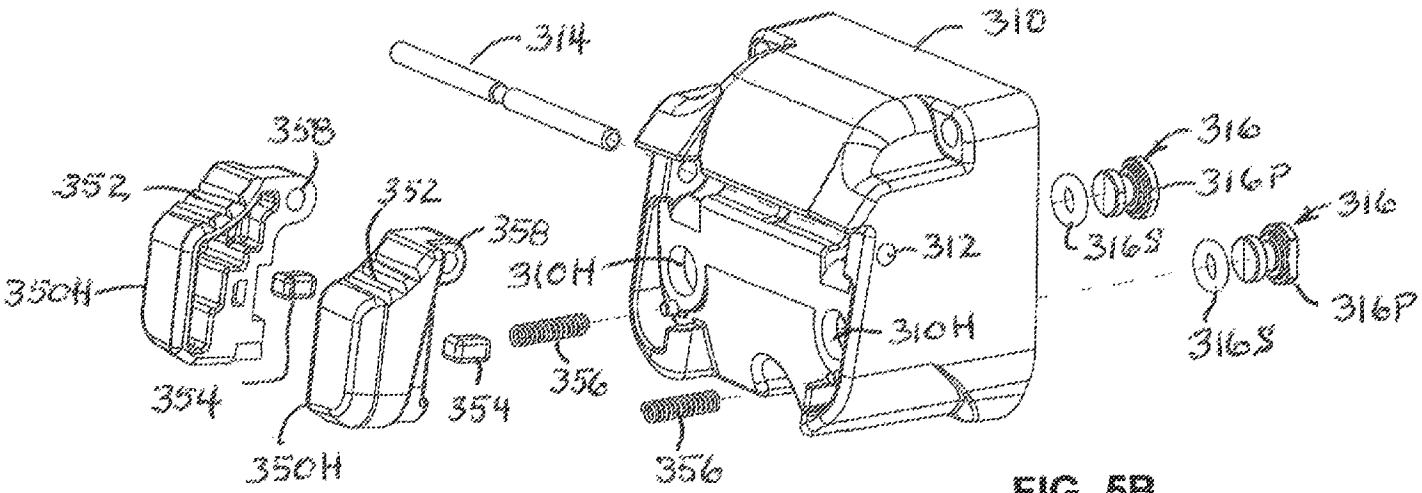
FIG. 5B is an exploded view of the tail cap thereof having the actuator of the first type.
Figure 6B:
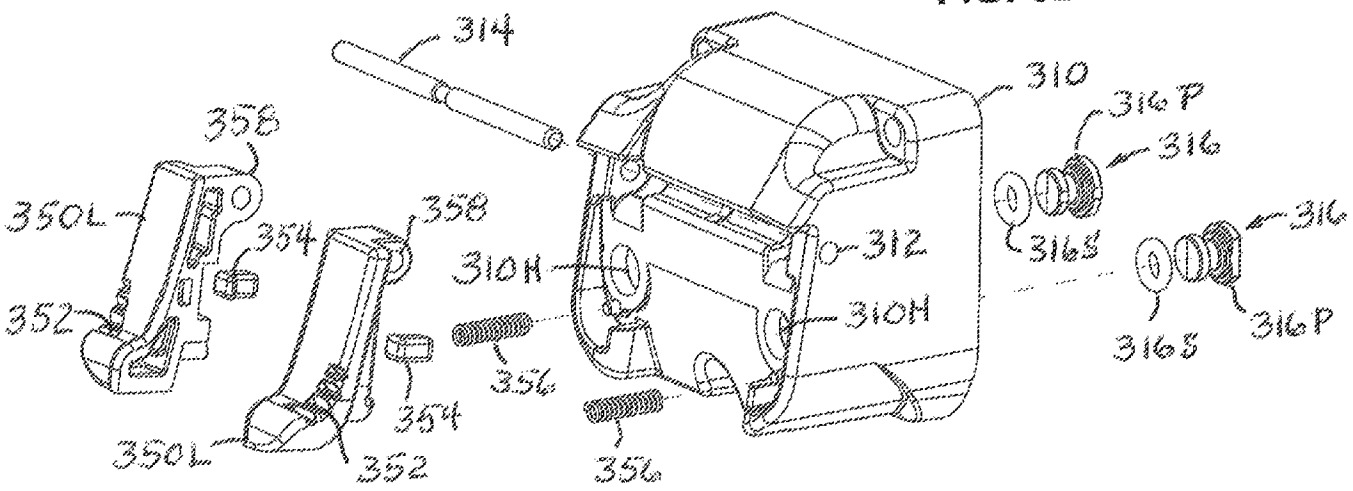
FIG. 6B is an exploded view of the tail cap thereof having the actuator of the second type.

FIG. 5A is an exploded view of the first example light 100 having the actuator 350 of the first type 350H, and FIG. 5B is an exploded view of the tail cap assembly 300 thereof having the actuator of the first type 350H; and FIG. 6A is an exploded view of the second example light 100' having the actuator 350 of the second type 350L, and FIG. 6B is an exploded view of the tail cap assembly 300' thereof having the actuator 350 of the second type 350L. The following description applies to all of the embodiments, even though references may be made only to light 100 and the various elements thereof.

Tail cap 300 is shown removed from body housing 210 after fasteners 302 are removed, which exposes the internal structure. Support structure 214 of body housing 210 extends rearwardly to support circuit board 250 that includes electronic circuitry for controlling light 100. Circuit board 250 has one or more electrical switches 252 thereon that are located in predetermined locations on circuit board 250 so that they are actuated when actuator 350, 350H, 350L is pressed, e.g., at actuator surface 352 or at certain other locations thereon, producing pivoting thereof towards housing 310. Movement of actuator 350, 350H, 350L in a direction toward tail cap housing 310 is coupled via slidable actuator member 316, sometimes referred to as a slidable actuator 316 or piston 316 or plunger 316, that is slidably disposed in a hole 310H of tail cap housing 310 to actuate electrical switch 252.

Actuators 350, 350H, 350L pivot about a pin or axle 314 that is disposed through coaxial pivot holes 312 through tail cap housing 310; pivot pin 314 also passes through pivot holes 358 at a first, or upper, end of actuators 350, 350H, 350L, whereby actuators 350, 350H, 350L are pivotable towards and away from housing 310. An actuator spring 356 disposed between each actuator 350, 350H, 350L and housing 310 biases actuator 350, 350H, 350L to pivot away from housing 310 and to return actuator 350, 350H, 350L to that position when pressure on actuator 350, 350H, 350L is released.

Actuator 350, 350H, 350L includes an actuation feature that is aligned with and extends toward electrical switch 352. Preferably, the actuation feature includes a bumper 354 is disposed in a recess in the side of actuator 350, 350H, 350L that is adjacent to housing 310 and extends to abut piston 316 at least when actuator 350, 350H, 350L is pressed to move piston 316 inwardly towards switch 252. Preferably, bumper 354 is of a resilient so as to be deformable to reduce the likelihood that excessive pressure applied to actuator 350, 350H, 350L is coupled to electrical switch 352, however, it may be a molded part of actuator 350, 350H, 350L.

The foregoing arrangement is the same for actuator 350H and 350L as well as for any other shaped actuator 350, so that the operation thereof is the same irrespective of the actuator 350, 350H, 350L employed. Preferably piston 316 includes a piston body 316P that has a circumferential groove into which a seal 316S, e.g., an O-ring 316S, is disposed to reduce the likelihood of dirt, debris and/or moisture entering tail cap housing 310.

Where a pair of actuators 350, 350H, 350L are employed, the structure and arrangement of each actuator 350, 350H, 350L is preferably the same. Actuators 350, 350H, 350L may have recesses therein in the side that is disposed adjacent to the trigger guard of a firearm for reducing the amount of material required therefor, e.g., a plastic or other molding material.

Figure 7:
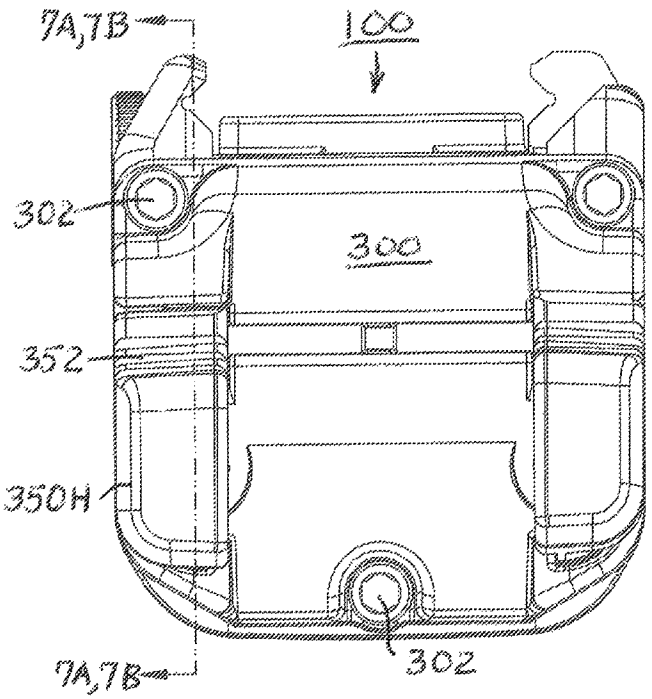
FIG. 7 is a rear view of the first example light having the actuator of the first type.
Figure 7A:
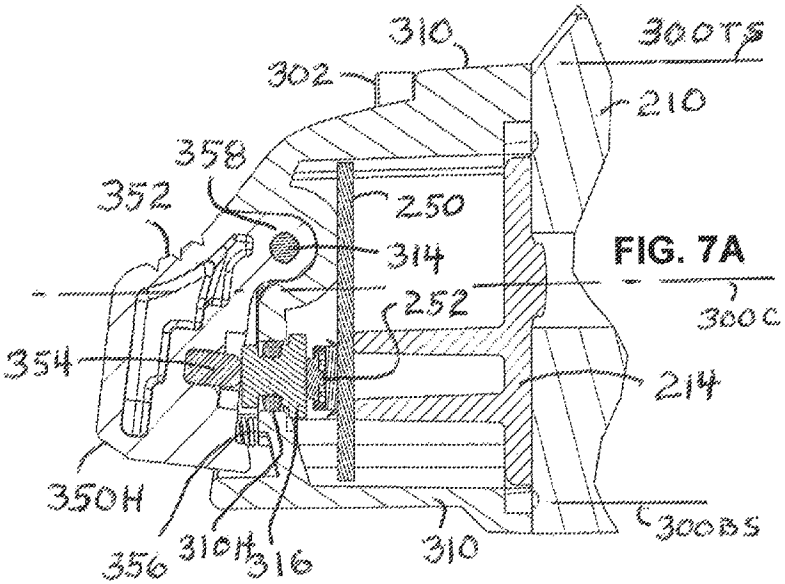
FIGS. 7A and 7B are cross-sectional views of the tail cap thereof having the actuator of the first type in un-actuated and actuated positions, respectively.
Figure 7B:
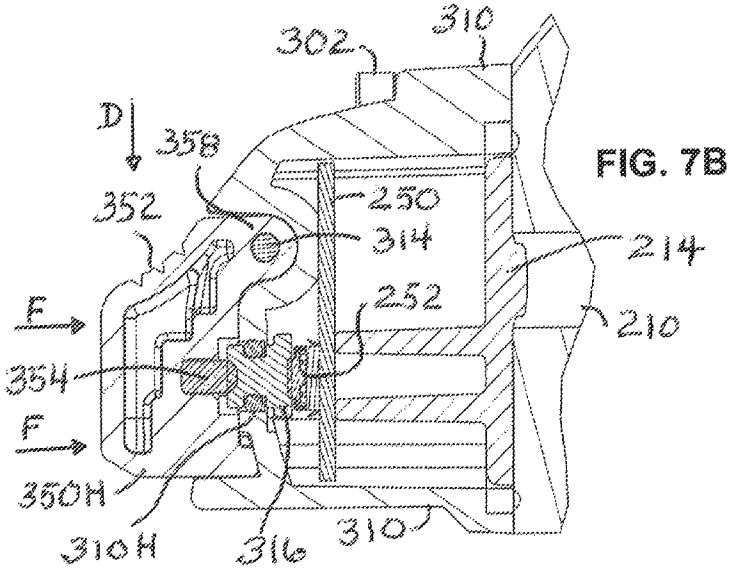
Figure 8:
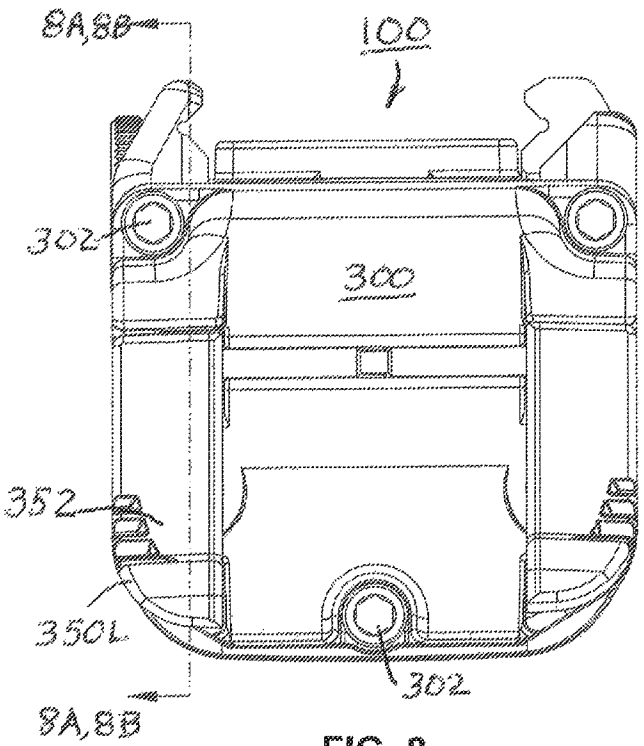
FIG. 8 is a rear view of the first example light having the actuator of the second type.
Figure 8A:
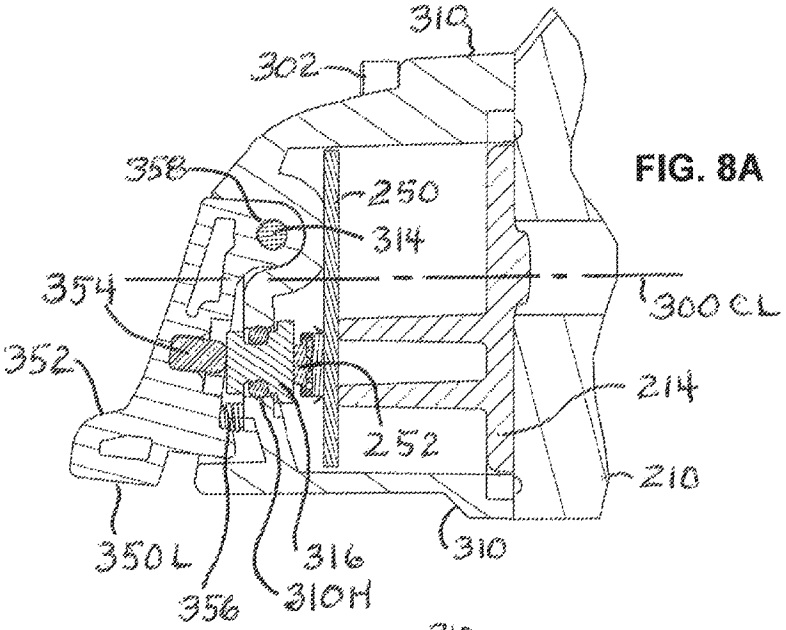
FIGS. 8A and 8B are cross-sectional views of the tail cap thereof having the actuator of the second type in un-actuated and actuated positions, respectively.
Figure 8B:
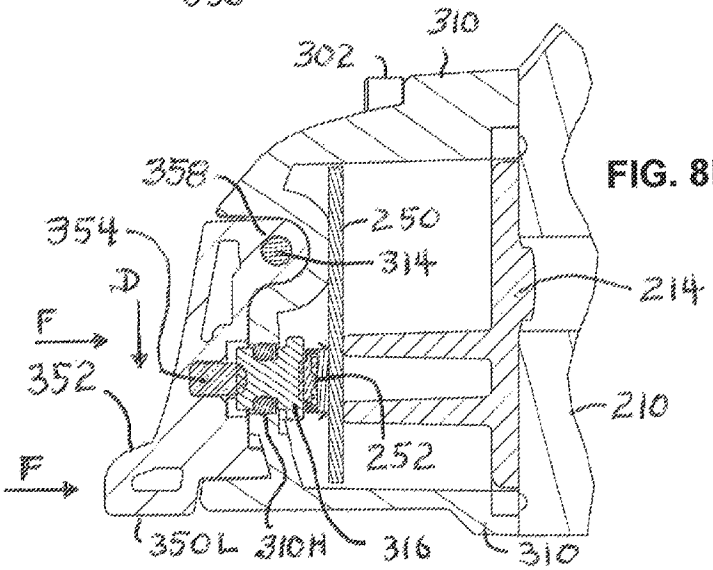

FIG. 7 is a rear view of the first example light 100 having the actuator 350 of the first type 350H, and FIGS. 7A and 7B are cross-sectional views of the tail cap assembly 300 thereof having the actuator 350 of the first type 350H in un-actuated and actuated positions, respectively; and FIG. 8 is a rear view of the first example light 100 having the actuator 350 of the second type 350L, and FIGS. 8A and 8B are cross-sectional views of the tail cap assembly 300' thereof having the actuator 350 of the second type 350L in un-actuated and actuated positions, respectively. The following description generally applies to all of the embodiments except as noted, and supplements the description relating to the preceding Figures.

For discussion, tail cap 310 and light 100 each have a centerline and the centerline of each is represented by centerline 300CL; in most instances both centerlines 300CL will be close to being the same line, but need not be, and so centerline 300CL herein represents either or both. In the example illustrations, centerline 300CL is substantially centered between the top 300TS of tail cap assembly 300 and the bottom 300BS thereof.

Each actuator 350, 350H, 350L has a pivot hole 358 near one end thereof, e.g., the end generally in an upper location when on light 100, 100', and has an actuator surface 352 on the surface thereof that is opposite to the surface adjacent to tail cap housing 310. Actuator surface 552 may be located at virtually any place along actuator 350 below pivot hole 358 to near to the bottom end of actuator 350. Actuator surface 352 of actuator 350H is located high on actuator 350H relatively close to pivot hole 358, i.e. above centerline 300CL, while actuator 352 of actuator 350L is located low on actuator 350L relatively close to the bottom of tail cap housing 310, i.e. below centerline 300CL.

Each actuator 350, 350H, 350L has an actuating feature 354, e.g., a bumper 354, that extends from the surface thereof at a location below the centerline 200CL, i.e. on the opposite side of centerline 300CL from pivot hole 358. Thus bumper 354 is spaced away from pivot hole 358.

Actuating feature 354, e.g., bumper 354, is proximate sliding actuator 316 which includes plunger body 316B or actuator body 316B surrounded by seal 316S, e.g., O-ring 316S, disposed in hole 310H through tail cap housing 310 and slidable therein. Spring 356 biases actuator 350, 350H, 350L away from tail cap housing 310 which allows bumper 354 and sliding actuator 316 to move away from electrical switch 252 on circuit board 250, whereby switch 252 is not actuated.

When actuator 350, 350H, 350L is actuated by a force (pressure) applied thereto sufficient to overcome the bias of spring 356, actuator 350, 350H, 350L moves toward tail cap housing 310 and switch 252 whereby actuating feature 354, e.g., bumper 354, moves toward switch 252 which caused sliding actuator 316 to move toward and actuate switch 252. When the actuating force (pressure) on actuator 350, 350H, 350L is released, actuator 350, 350H, 350L and sliding actuator 316 move outwardly and switch 252 returns to its un-actuated condition.

Actuating force (pressure) may be applied over a relatively wide range of directions (angles) relative to the centerline 300CL examples of which are shown by the example arrows in FIGS. 7B and 8B. Actuating force may be applied in a downward direction as illustrated by arrow D, e.g., substantially transverse to centerline 300CL, and may be applied in a forward direction as illustrated by arrows F, e.g., substantially parallel to centerline 300CL. This feature is advantageous because it allows light 100, 100' to accommodate a wider variety of user anatomies and finger movements.

Plural arrows F illustrate that generally forwardly directed actuating force may be applied at almost any location along the rearward surface of actuator 350, 350H, 350L. Actuating force may be applied at least in any direction including and between those illustrated by arrow D and those illustrated by arrows F, e.g., at least over a range of angles of about 90°. In practice, downward actuation force (arrow D) may be angled to be somewhat forward of actuating surface 352 so as to be in a direction that is closer to being parallel with the sloping rear surface of actuator 350, 350H, 350L, and forward actuation force (arrows F) may be angled so as to be in an upward direction that is not parallel with centerline 300CL the rear surface of actuator 350, 350H, 350L, e.g., at least over a range of angles in excess of 90°. The foregoing are advantageous because the allows light 100, 100' to be actuated by a wider variety of user anatomies and finger movements.

The foregoing is believed to result from the configuration of tail cap assembly 300, 300' wherein actuators 350, 350H, 350L have a pivot 358, 314 or hinge 358, 314 that is substantially above centerline 300CL and have an actuating feature 354 that is spaced apart from pivot 358, 314 and is substantially below centerline 300CL.

A portable light 10 may comprise: a light body including a body housing having a cavity for a source of electrical power, a light head at a forward end of the body housing including a light source for providing light, and a tail cap assembly at a rearward end of the body housing, wherein the light body includes an electrical switch therein for selectively energizing the light source of the light head for producing light, and wherein the light body defines a centerline; the tail cap assembly including a tail cap housing and at least one actuator thereon, wherein one end of the actuator is pivotably mounted to an exterior surface of the tail cap housing at a location spaced away from the centerline in a first direction, wherein the actuator extends beyond the center line in a direction opposite to the first direction and has an actuation feature thereat that is spaced apart from the pivotable mounting and that extends towards the exterior surface of the tail cap housing for actuating the electrical switch therein when the actuator is pivoted towards the exterior surface of the tail cap assembly, wherein the centerline is between the pivotable mounting of the actuator and the actuation feature thereof. The light body may include a clamping arrangement for attaching the portable light 10 to an object, wherein the pivotable mounting of the actuator is disposed between the centerline and the clamping arrangement. The object may be a firearm. The at least one actuator of the tail cap assembly may include a pair of actuators located near opposite ends of the exterior surface of the tail cap housing and wherein the pair of actuators are spaced apart for receiving a part of a firearm therebetween when the portable light 10 is mounted to the firearm by the clamping arrangement. The tail cap housing may include a slidable actuator member located in an opening through the exterior surface thereof located for slidably coupling pivoting movement of the actuator via the actuation feature to the electrical switch. The slidable actuator member may include a body having a circumferential groove and a seal disposed in the circumferential groove. The actuation feature of the actuator may include a bumper extending therefrom located to contact the slidable actuator member when the actuator is pivoted toward the exterior surface of the tail cap housing. The actuation feature of the actuator may include a bumper extending therefrom to couple movement of the actuator to the electrical switch when the actuator is pivoted toward the exterior surface of the tail cap housing. The portable light 10 may further include a spring disposed between the actuator and the tail cap housing to bias the actuator to move away from the exterior surface of the tail cap housing. The actuator may have an actuation surface extending from a longer side thereof that is not adjacent to the exterior surface, wherein the actuation surface is located on the actuator at the center line or at a location away from the centerline in either direction along the longer side of the actuator. The actuator may be one of a set of actuators, each actuator of the set thereof including an actuation surface on a longer side thereof, wherein at least one actuator of the set thereof has the actuation surface thereof located on the actuator at a location along the longer side of the actuator away from the centerline in the first direction and at least one other actuator of the set thereof has the actuation surface thereof located on the actuator at a location along the longer side of the actuator away from the centerline in a direction opposite to the first direction. The tail cap assembly may be one of a set of interchangeable tail cap assemblies, each interchangeable tail cap assembly of the set thereof including an actuator having an actuation surface on a longer side thereof, wherein at least one interchangeable tail cap assembly of the set thereof has the actuation surface of the actuator thereof located at a location along the longer side thereof away from the centerline in the first direction and at least one other interchangeable tail cap assembly of the set thereof has the actuation surface of the actuator thereof located at a location along the longer side of the actuator away from the centerline in a direction opposite to the first direction. The actuation surface of the actuator has a plurality of ridges thereon. The at least one actuator of each the interchangeable tail cap assembly of the set may include a pair of actuators located near opposite ends of the exterior surface of the tail cap housing and wherein each of the pair of actuators has its actuation surface in the same respective location thereon. The at least one actuator provides an ON/OFF function and a mode selection of the light source.

A portable light 10 may comprise: a light body including a body housing having a cavity for a source of electrical power, a light head at a forward end of the body housing including a light source for providing light, and an interchangeable tail cap assembly at a rearward end of the body housing, wherein the light body includes an electrical switch therein for selectively energizing the light source of the light head for producing light, wherein the light body defines a centerline, and wherein the interchangeable tail cap assembly is one of a set of interchangeable tail cap assemblies; each interchangeable tail cap assembly of the set thereof including a tail cap housing and at least one actuator thereon, wherein one end of the actuator is pivotably mounted to an exterior surface of the tail cap housing at a location spaced away from the centerline in a first direction, wherein the actuator extends beyond the center line in a direction opposite to the first direction and has an actuation feature thereat that is spaced apart from the pivotable mounting and that extends towards the exterior surface of the tail cap housing for actuating the electrical switch in the light body when the actuator is pivoted towards the exterior surface of the tail cap assembly, wherein the centerline is between the pivotable mounting of the actuator and the actuation feature thereof; and wherein at least one interchangeable tail cap assembly of the set thereof has an actuation surface of the actuator thereof located at a location along a longer side thereof away from the centerline in the first direction and at least one other interchangeable tail cap assembly of the set thereof has the actuation surface of the actuator thereof located at a location along the longer side of the actuator away from the centerline in a direction opposite to the first direction. The light body may include a clamping arrangement for attaching the portable light 10 to an object, wherein the pivotable mounting of the actuator is disposed between the centerline and the clamping arrangement. The object may be a firearm. The at least one actuator of the interchangeable tail cap assembly may include a pair of actuators located near opposite ends of the exterior surface of the tail cap housing and wherein the pair of actuators are spaced apart for receiving a part of a firearm therebetween when the portable light 10 is mounted to the firearm by the clamping arrangement. Each interchangeable tail cap housing may include a slidable actuator member located in an opening through the exterior surface thereof located for slidably coupling pivoting movement of the actuator via the actuation feature to the electrical switch. The slidable actuator member may include a body having a circumferential groove and a seal disposed in the circumferential groove. The actuation feature of the actuator may include a bumper extending therefrom located to contact the slidable actuator member when the actuator is pivoted toward the exterior surface of the tail cap housing. The actuation feature of the actuator may include a bumper extending therefrom to couple movement of the actuator to the electrical switch when the actuator is pivoted toward the exterior surface of the tail cap housing. The portable light 10 may further include a spring disposed between the actuator and the tail cap housing to bias the actuator to move away from the exterior surface of the tail cap housing. The actuation surface of the actuator may have a plurality of ridges thereon. The at least one actuator of each the interchangeable tail cap assembly of the set may include a pair of actuators located near opposite ends of the exterior surface of the tail cap housing and wherein each of the pair of actuators has its actuation surface in the same respective location thereon. The at least one actuator may provide an ON/OFF function and a mode selection of the light source.

A portable light 10 may comprise: a light body including a body housing having a cavity for a source of electrical power and having a clamping arrangement on one side thereof for attaching the portable light 10 to a firearm, a light head at a forward end of the body housing including a light source for providing light, and an interchangeable tail cap assembly at a rearward end of the body housing, wherein the light body includes an electrical switch therein for selectively energizing the light source of the light head for producing light, wherein the light body defines a centerline, and wherein the interchangeable tail cap assembly is one of a set of interchangeable tail cap assemblies; each interchangeable tail cap assembly of the set thereof including a tail cap housing and at least one actuator thereon, wherein one end of the actuator is pivotably mounted to an exterior surface of the tail cap housing at a location spaced away from the centerline in a first direction towards the one side of the body housing, wherein the actuator extends beyond the center line in a direction opposite to the first direction and has an actuation feature thereat that is spaced apart from the pivotable mounting and that extends towards the exterior surface of the tail cap housing for actuating the electrical switch in the light body when the actuator is pivoted towards the exterior surface of the tail cap assembly, wherein the centerline is between the pivotable mounting of the actuator and the actuation feature thereof; and wherein at least one interchangeable tail cap assembly of the set thereof has an actuation surface of the actuator thereof located at a location along a longer side thereof away from the centerline in the first direction and at least one other interchangeable tail cap assembly of the set thereof has the actuation surface of the actuator thereof located at a location along the longer side of the actuator away from the centerline in a direction opposite to the first direction. Each interchangeable tail cap housing may include a slidable actuator member located in an opening through the exterior surface thereof located for slidably coupling pivoting movement of the actuator via the actuation feature to the electrical switch. The slidable actuator member may include a body having a circumferential groove and a seal disposed in the circumferential groove. The actuation feature of the actuator may include a bumper extending therefrom located to contact the slidable actuator member when the actuator is pivoted toward the exterior surface of the tail cap housing. The actuation feature of the actuator may include a bumper extending therefrom to couple movement of the actuator to the electrical switch when the actuator is pivoted toward the exterior surface of the tail cap housing. The portable light 10 may further include a spring disposed between the actuator and the tail cap housing to bias the actuator to move away from the exterior surface of the tail cap housing. The at least one actuator of the interchangeable tail cap assembly may include a pair of actuators located near opposite ends of the exterior surface of the tail cap housing and wherein the pair of actuators are spaced apart for receiving a part of a firearm therebetween when the portable light 10 is mounted to the firearm by the clamping arrangement. The at least one actuator may provide an ON/OFF function and a mode selection of the light source.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate"whether or not expressly stated to be such. It is noted that embodiments of very different sizes, shapes and dimensions may employ the described arrangements.

Although terms such as "front," "back," "rear," "side," "end," "top," "bottom," "up," "down," "left," "right," "upward," "downward," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation and/or direction should be understood as being for convenience only, and not as limiting of the invention as claimed.

As used herein, the term "and/or" encompasses both the conjunctive and the disjunctive cases, so that a phrase in the form "A and/or B" encompasses "A" or "B" or "A and B" and a phrase in the form "A, B and/or C" includes "A," "B," "C," "A and B," "A and C," "B and C," and "A and B and C." In addition, the term "at least one of" one or more elements is intended to include one of any one of the elements, more than one of any of the elements, and two or more of the elements up to and including all of the elements, and so, e.g., phrases in the form "at least one of A, B and C" include "A," "B," "C," "A and B," "A and C," "B and C," and "A and B and C."

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

As used herein, the terms "connected" and "coupled" as well as variations thereof may or may not be intended to be exact synonyms, but may also encompass some similar things and some different things. The term "connected" as indicated by its context may be used generally to refer to elements that have a direct electrical and/or physical contact to each other, whereas the term "coupled" as indicated by its context may be used generally to refer to elements that have an indirect electrical and/or physical contact with each other, e.g., via one or more intermediate elements, so as to cooperate and/or interact with each other, and may include elements in direct contact as well.

While the present invention has been described in terms of the foregoing example embodiments, variations within the scope and spirit of the present invention as defined by the claims following will be apparent to those skilled in the art. For example, actuator 350 may have any desired shape and is not limited to the illustrated HI and LO example embodiments. Further, the length thereof may be, e.g., longer than illustrated so the end thereof distal from the pivot may extend below the bottom of light 100, 100' or may be curved so as to extend away from light body 200, 200' to be closer to a user's fingers.

Tail cap assemblies 300 having different actuators 350, 350H, 350L are interchangeable on different units of light 100, and tail cap assemblies 300' having different actuators 350, 350H, 350L are interchangeable on different units of light 100', e.g., by removing one tail cap assembly 300, 300' and replacing it with another tail cap assembly 300, 300'.

Alternatively, if body housings 210, 210' of lights 100, 100' were to have the same configuration at their rearward ends, then both kinds of tail cap assemblies 300 and 300', whether or not having different actuators 350, 350H, 350L, would be interchangeable on different units of light 100 and 100', e.g., by removing one tail cap assembly 300, 300' and replacing it with another tail cap assembly 300 or 300'.

It is noted that while interchanging tail caps 300 is the preferred manner for changing actuators 350 from one configuration to another, it is contemplated that the actuator 350 of a tail cap 300 could be removed and be replaced by a different actuator 350, e.g., replacing a 350H with a 350L, or replacing a damaged actuator 350. The former is manner preferred, e.g., inter alia because it is thought that fasteners 302 are less likely to be lost by the user or become damaged when changing a tail cap 300 than are the small parts of tail cap 300 and actuator 350 that are freed when an actuator 350 is removed, e.g., by removing the pivot pin 314 that pivotably retains actuator 350 on tail cap housing 310, 310'.

Actuator 350, 350H, 350L may include an actuation feature provided by a bumper 354 in a recess therein as described and illustrated, or the actuation feature may be part of the shape of actuator 350, 350H, 350L, e.g., molded integrally therewith.

Alternatively to a piston or plunger 316, the actuating feature on the housing facing side of actuator 350, 350H, 350L may extend through hole 310H in tail cap housing 310 for actuating electrical switch 252. In such embodiment, an O-ring or grommet may be provided in hole 310H to provide a seal.

While two different example light embodiments are illustrated herein, the present arrangement for interchangeable tail caps and/or for interchangeable actuators may be employed with light bodies of a wide variety of very different lights.

While certain features may be described as a raised feature, e.g., a ridge, boss, flange, projection, detent, or other raised feature, such feature may be positively formed or may be what remains after a recessed feature, e.g., a groove, slot, hole, indentation, recess, detent, or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made. In addition, where a raised feature engages a recessed feature, such as a cylindrical projection that engages a complementary receptacle, the relative positions of the raised and recessed features may be interchanged or other wise modified.

Each of the U.S. Provisional Applications, U.S. Patent Applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a light body including a body housing having a cavity for a source of electrical power, a light head at a forward end of said body housing including a light source for providing light, and a tail cap assembly at a rearward end of said body housing, wherein said light body includes an electrical switch therein for selectively energizing the light source of the light head for producing light, and wherein said light body defines a centerline;

said tail cap assembly including a tail cap housing and at least one actuator thereon, wherein one end of said actuator is pivotably mounted to an exterior surface of said tail cap housing at a location spaced away from the centerline in a first direction, wherein said actuator extends beyond the center line in a direction opposite to the first direction and has an actuation feature thereat that is spaced apart from the pivotable mounting and that extends towards the exterior surface of said tail cap housing for actuating the electrical switch therein when said actuator is pivoted towards the exterior surface of said tail cap assembly, wherein the centerline is between the pivotable mounting of said actuator and the actuation feature thereof.

2. The portable light of claim 1 wherein said light body includes a clamping arrangement for attaching said portable light to an object, wherein the pivotable mounting of said actuator is disposed between the centerline and the clamping arrangement.

3. The portable light of claim 2 wherein the object is a firearm.

4. The portable light of claim 2 wherein the at least one actuator of said tail cap assembly includes a pair of actuators located near opposite ends of the exterior surface of said tail cap housing and wherein the pair of actuators are spaced apart for receiving a part of a firearm therebetween when the portable light is mounted to the firearm by said clamping arrangement.

5. The portable light of claim 1 wherein said tail cap housing includes a slidable actuator member located in an opening through the exterior surface thereof located for slidably coupling pivoting movement of said actuator via the actuation feature to the electrical switch.

6. The portable light of claim 5 wherein the slidable actuator member includes a body having a circumferential groove and a seal disposed in the circumferential groove.

7. The portable light of claim 5 wherein the actuation feature of said actuator includes a bumper extending therefrom located to contact the slidable actuator member when said actuator is pivoted toward the exterior surface of said tail cap housing.

8. The portable light of claim 1 wherein the actuation feature of said actuator includes a bumper extending therefrom to couple movement of said actuator to the electrical switch when said actuator is pivoted toward the exterior surface of said tail cap housing.

9. The portable light of claim 1 further including a spring disposed between said actuator and said tail cap housing to bias said actuator to move away from the exterior surface of said tail cap housing.

10. The portable light of claim 1 wherein said actuator has an actuation surface extending from a longer side thereof that is not adjacent to the exterior surface, wherein the actuation surface is located on said actuator at the center line or at a location away from the centerline in either direction along the longer side of said actuator.

11. The portable light of claim 1 wherein said actuator is one of a set of actuators, each actuator of the set thereof including an actuation surface on a longer side thereof, wherein at least one actuator of the set thereof has the actuation surface thereof located on said actuator at a location along the longer side of said actuator away from the centerline in the first direction and at least one other actuator of the set thereof has the actuation surface thereof located on said actuator at a location along the longer side of said actuator away from the centerline in a direction opposite to the first direction.

12. The portable light of claim 1 wherein said tail cap assembly is one of a set of interchangeable tail cap assemblies, each interchangeable tail cap assembly of the set thereof including an actuator having an actuation surface on a longer side thereof, wherein at least one interchangeable tail cap assembly of the set thereof has the actuation surface of the actuator thereof located at a location along the longer side thereof away from the centerline in the first direction and at least one other interchangeable tail cap assembly of the set thereof has the actuation surface of the actuator thereof located at a location along the longer side of said actuator away from the centerline in a direction opposite to the first direction.

13. The portable light of claim 1 wherein the actuation surface of the actuator has a plurality of ridges thereon.

14. The portable light of claim 1 wherein the at least one actuator of each said interchangeable tail cap assembly of the set includes a pair of actuators located near opposite ends of the exterior surface of said tail cap housing and wherein each of the pair of actuators has its actuation surface in the same respective location thereon.

15. The portable light of claim 1 wherein the at least one actuator provides an ON/OFF function and a mode selection of the light source.

16. A portable light comprising:

a light body including a body housing having a cavity for a source of electrical power, a light head at a forward end of said body housing including a light source for providing light, and an interchangeable tail cap assembly at a rearward end of said body housing, wherein said light body includes an electrical switch therein for selectively energizing the light source of the light head for producing light, wherein said light body defines a centerline, and wherein said interchangeable tail cap assembly is one of a set of interchangeable tail cap assemblies;

each said interchangeable tail cap assembly of the set thereof including a tail cap housing and at least one actuator thereon, wherein one end of said actuator is pivotably mounted to an exterior surface of said tail cap housing at a location spaced away from the centerline in a first direction, wherein said actuator extends beyond the center line in a direction opposite to the first direction and has an actuation feature thereat that is spaced apart from the pivotable mounting and that extends towards the exterior surface of said tail cap housing for actuating the electrical switch in said light body when said actuator is pivoted towards the exterior surface of said tail cap assembly, wherein the centerline is between the pivotable mounting of said actuator and the actuation feature thereof; and wherein at least one interchangeable tail cap assembly of the set thereof has an actuation surface of the actuator thereof located at a location along a longer side thereof away from the centerline in the first direction and at least one other interchangeable tail cap assembly of the set thereof has the actuation surface of the actuator thereof located at a location along the longer side of said actuator away from the centerline in a direction opposite to the first direction.

17. The portable light of claim 16 wherein said light body includes a clamping arrangement for attaching said portable light to an object, wherein the pivotable mounting of said actuator is disposed between the centerline and the clamping arrangement.

18. The portable light of claim 17 wherein the object is a firearm.

19. The portable light of claim 17 wherein the at least one actuator of said interchangeable tail cap assembly includes a pair of actuators located near opposite ends of the exterior surface of said tail cap housing and wherein the pair of actuators are spaced apart for receiving a part of a firearm therebetween when the portable light is mounted to the firearm by said clamping arrangement.

20. The portable light of claim 16 wherein each said interchangeable tail cap housing includes a slidable actuator member located in an opening through the exterior surface thereof located for slidably coupling pivoting movement of said actuator via the actuation feature to the electrical switch.

21. The portable light of claim 20 wherein the slidable actuator member includes a body having a circumferential groove and a seal disposed in the circumferential groove.

22. The portable light of claim 20 wherein the actuation feature of said actuator includes a bumper extending therefrom located to contact the slidable actuator member when said actuator is pivoted toward the exterior surface of said tail cap housing.

23. The portable light of claim 16 wherein the actuation feature of said actuator includes a bumper extending therefrom to couple movement of said actuator to the electrical switch when said actuator is pivoted toward the exterior surface of said tail cap housing.

24. The portable light of claim 16 further including a spring disposed between said actuator and said tail cap housing to bias said actuator to move away from the exterior surface of said tail cap housing.

25. The portable light of claim 16 wherein the actuation surface of the actuator has a plurality of ridges thereon.

26. The portable light of claim 16 wherein the at least one actuator of each said interchangeable tail cap assembly of the set includes a pair of actuators located near opposite ends of the exterior surface of said tail cap housing and wherein each of the pair of actuators has its actuation surface in the same respective location thereon.

27. The portable light of claim 16 wherein the at least one actuator provides an ON/OFF function and a mode selection of the light source.

28. A portable light comprising:

a light body including a body housing having a cavity for a source of electrical power and having a clamping arrangement on one side thereof for attaching said portable light to a firearm, a light head at a forward end of said body housing including a light source for providing light, and an interchangeable tail cap assembly at a rearward end of said body housing, wherein said light body includes an electrical switch therein for selectively energizing the light source of the light head for producing light, wherein said light body defines a centerline, and wherein said interchangeable tail cap assembly is one of a set of interchangeable tail cap assemblies;

each said interchangeable tail cap assembly of the set thereof including a tail cap housing and at least one actuator thereon, wherein one end of said actuator is pivotably mounted to an exterior surface of said tail cap housing at a location spaced away from the centerline in a first direction towards the one side of said body housing, wherein said actuator extends beyond the center line in a direction opposite to the first direction and has an actuation feature thereat that is spaced apart from the pivotable mounting and that extends towards the exterior surface of said tail cap housing for actuating the electrical switch in said light body when said actuator is pivoted towards the exterior surface of said tail cap assembly, wherein the centerline is between the pivotable mounting of said actuator and the actuation feature thereof; and wherein at least one interchangeable tail cap assembly of the set thereof has an actuation surface of the actuator thereof located at a location along a longer side thereof away from the centerline in the first direction and at least one other interchangeable tail cap assembly of the set thereof has the actuation surface of the actuator thereof located at a location along the longer side of said actuator away from the centerline in a direction opposite to the first direction.

29. The portable light of claim 28 wherein each said interchangeable tail cap housing includes a slidable actuator member located in an opening through the exterior surface thereof located for slidably coupling pivoting movement of said actuator via the actuation feature to the electrical switch.

30. The portable light of claim 29 wherein the slidable actuator member includes a body having a circumferential groove and a seal disposed in the circumferential groove.

31. The portable light of claim 29 wherein the actuation feature of said actuator includes a bumper extending therefrom located to contact the slidable actuator member when said actuator is pivoted toward the exterior surface of said tail cap housing.

32. The portable light of claim 28 wherein the actuation feature of said actuator includes a bumper extending therefrom to couple movement of said actuator to the electrical switch when said actuator is pivoted toward the exterior surface of said tail cap housing.

33. The portable light of claim 28 further including a spring disposed between said actuator and said tail cap housing to bias said actuator to move away from the exterior surface of said tail cap housing.

34. The portable light of claim 28 wherein the at least one actuator of said interchangeable tail cap assembly includes a pair of actuators located near opposite ends of the exterior surface of said tail cap housing and wherein the pair of actuators are spaced apart for receiving a part of a firearm therebetween when the portable light is mounted to the firearm by said clamping arrangement.

35. The portable light of claim 28 wherein the at least one actuator provides an ON/OFF function and a mode selection of the light source.

* * * * *